US008254796B2

(12) United States Patent
Oyoshi

(10) Patent No.: US 8,254,796 B2
(45) Date of Patent: Aug. 28, 2012

(54) IMAGE FORMING APPARATUS AND METHOD FOR CONTROLLING IMAGE FORMING APPARATUS

(75) Inventor: Kazuhiro Oyoshi, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 246 days.

(21) Appl. No.: 12/623,285

(22) Filed: Nov. 20, 2009

(65) Prior Publication Data

US 2010/0129100 A1 May 27, 2010

(30) Foreign Application Priority Data

Nov. 25, 2008 (JP) ..... 2008-299641

(51) Int. Cl.
*G03G 15/08* (2006.01)
*G03G 15/20* (2006.01)

(52) U.S. Cl. ..... 399/29; 399/68

(58) Field of Classification Search ..... 399/29, 399/68

See application file for complete search history.

(56) References Cited

U.S. PATENT DOCUMENTS

2002/0097314 A1 7/2002 Okano

FOREIGN PATENT DOCUMENTS

| | | | |
|---|---|---|---|
| JP | 2002-244370 A | | 8/2002 |
| JP | 2004085707 A | * | 3/2004 |
| JP | 2007078942 A | * | 3/2007 |
| JP | 2007-206412 A | | 8/2007 |

OTHER PUBLICATIONS

Kosugi (JP 2007-078942 A) JPO Machine Translation.*

* cited by examiner

*Primary Examiner* — David Gray
*Assistant Examiner* — Erika J Villaluna
(74) *Attorney, Agent, or Firm* — Canon U.S.A., Inc. IP Division

(57) ABSTRACT

An image forming apparatus controls a sheet to be conveyed to a fixing unit with a first conveyance speed in case a charged amount of a recording agent in a developing unit is larger than a predetermined charged amount, and controls the sheet to be conveyed to the fixing unit with a second conveyance speed, which is slower than the first conveyance speed, when the charged amount of the recording agent in the developing unit is smaller than the predetermined charged amount.

7 Claims, 6 Drawing Sheets

FIG.5

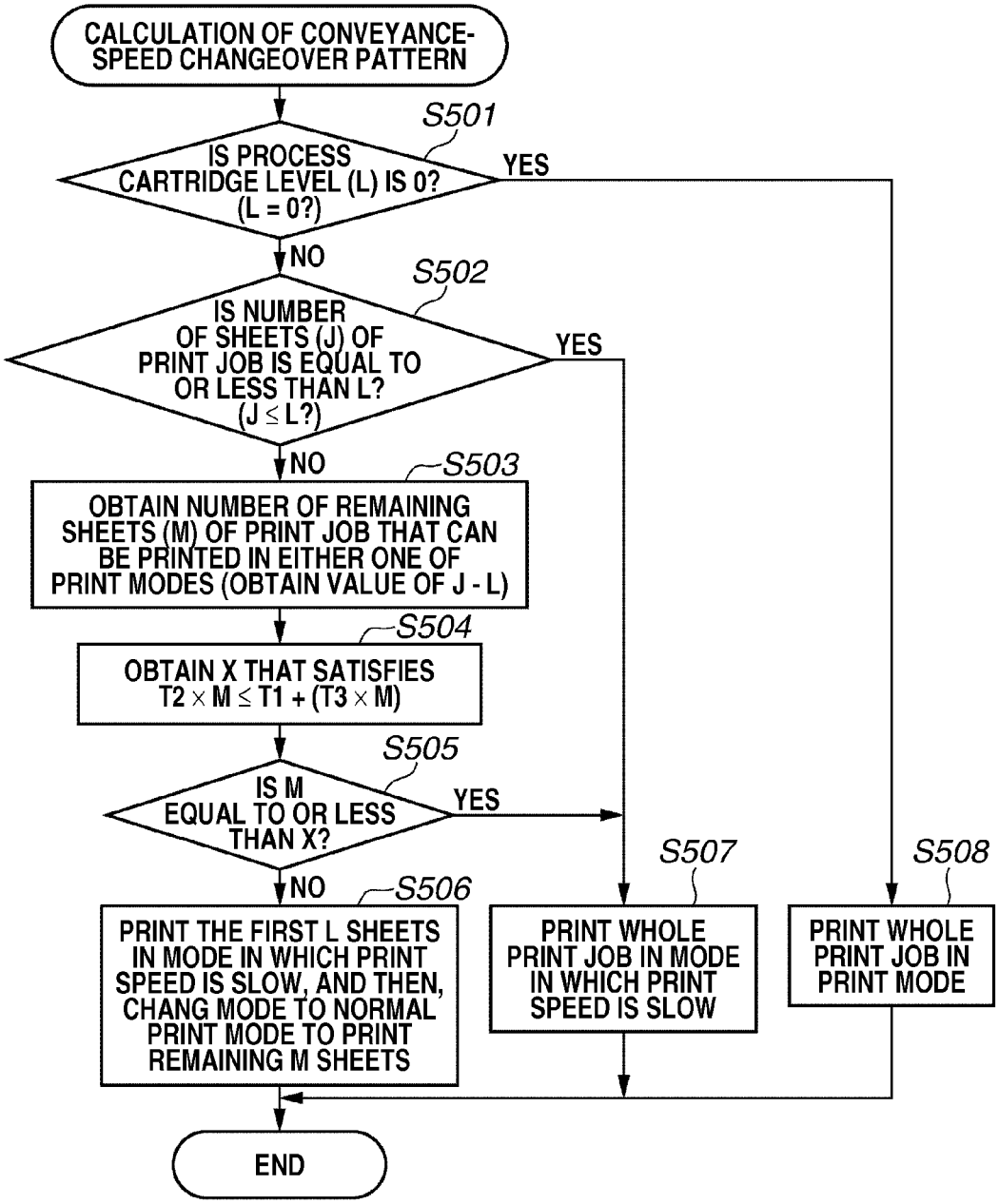

L = LEVEL OF PROCESS CARTRIDGE
J = NUMBER OF SHEETS OF PRINT JOB
T1 = TIME FOR CHANGING PRINT MODE
T2 = TIME FOR PRINTING ONE SHEET IN MODE IN WHICH PRINT SPEED IS SLOW
T3 = TIME FOR PRINTING ONE SHEET IN NORMAL PRINT MODE
M = NUMBER OF REMAINING SHEETS OF PRINT JOB THAT CAN BE PRINTED IN EITHER ONE OF PRINT MODES (VALUE OF J - L)
X = NUMBER OF PAGES THAT IS BETTER PRINTED IN MODE IN WHICH PRINT SPEED IS SLOW THAN THAT IS PRINTED WITH PRINT MODE CHANGED TO NORMAL ONE, IN ORDER TO SHORTEN THE TIME FOR PRINTING

IMAGE FORMING APPARATUS AND METHOD FOR CONTROLLING IMAGE FORMING APPARATUS

BACKGROUND OF THE INVENTION

1. Field of the Invention

The present invention relates to an image forming apparatus, and a method for controlling an image forming apparatus.

2. Description of the Related Art

When a recording sheet passes through a fixing unit of an image forming apparatus, water vapor is generated due to water contained in the recording sheet. In this case, toner (recording agent) on the recording sheet traps the water vapor, thereby generating a phenomenon in which the water vapor blows away non-fixed toner.

This phenomenon is noticeable in a thin line. For example, this phenomenon is called "tailing", because it seems that a ruled line arranged in the direction parallel to the conveyance direction of the recording sheet leaves trails in spots in the direction perpendicular to the conveyance direction of the recording sheet. The factor causing the tailing will be described below.

Japanese Patent Application Laid-Open No. 2007-206412 discusses a technique for suppressing the generation of density nonuniformity in printing by changing a print speed according to a remaining amount of toner in a cartridge. The technique in Japanese Patent Application Laid-Open No. 2007-206412 pays attention to the relationship between the remaining amount of toner and toner replenishing ability, wherein the print speed is reduced for securing the toner replenishing ability, when the remaining amount of toner becomes a threshold value or less.

Japanese Patent Application Laid-Open No. 2002-244370 discusses a technique in which an edge of image data is detected according to the state of use of a cartridge (information about number of pages, and used amount of toner) for correcting density of the image data in the edge to thereby suppress the generation of a trailing image.

Japanese Patent Application Laid-Open No. 2007-206412 neither pays attention to the relationship between the remaining amount of toner and the generation of a trailing image, nor aims to suppress the generation of the trailing image. Therefore, in Japanese Patent Application Laid-Open No. 2007-206412, the print speed is high when the remaining amount of toner is sufficient. Accordingly, the trailing image is likely to occur (the reason thereof will be described below).

Although the technique in Japanese Patent Application Laid-Open No. 2002-244370 is to suppress the generation of the trailing image, the control thereof is extremely complicated, because the edge in the image data is detected, and then, the density of the image data in the edge is corrected. In Japanese Patent Application Laid-Open No. 2002-244370, since the density of the image data is changed, the density of the image, which is to be actually outputted, is different from the density of the image a user intends.

SUMMARY OF THE INVENTION

According to an aspect of the present invention, an apparatus includes a developing unit configured to develop an image onto a photosensitive drum with the use of a recording agent; a transfer unit configured to transfer the developed image onto a sheet; a fixing unit configured to fix the transferred image transferred; and a control unit configured to control the sheet to be conveyed to the fixing unit with a first conveyance speed in case a charged amount of the recording agent is greater than a predetermined charged amount, and to control the sheet to be conveyed to the fixing unit with a second conveyance speed, which is slower than the first conveyance speed, in case the charged amount is smaller than the predetermined charged amount.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

FIG. 5 is a flowchart illustrating one example of a process for calculating a conveyance-speed changeover pattern of a recording sheet.

DESCRIPTION OF THE EMBODIMENTS

Figure 1:
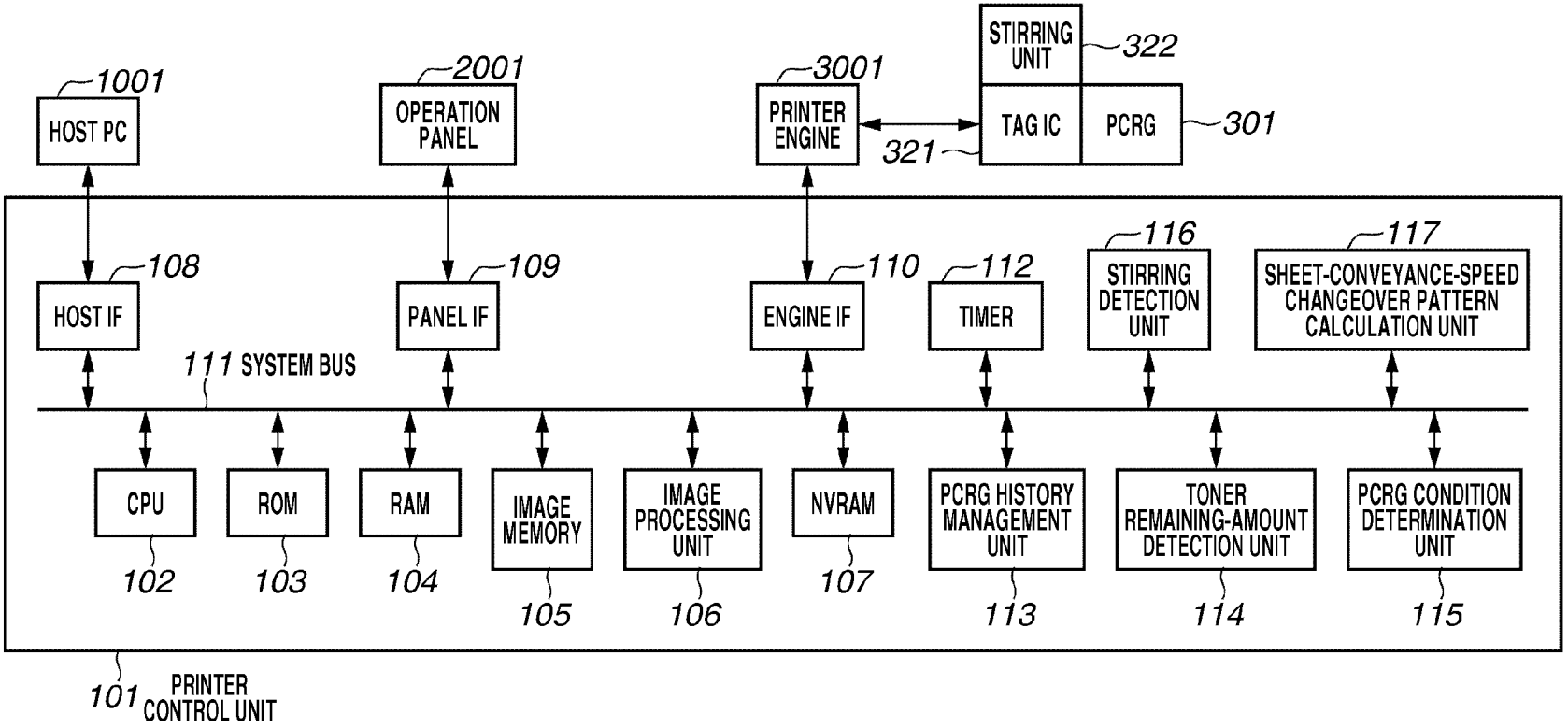
FIG. 1 is a block diagram illustrating an example of a configuration of a printer.

Various exemplary embodiments, features, and aspects of the invention will be described in detail below with reference to the drawings.

Before describing an exemplary embodiment according to the present invention, the tailing will be described. There is a tendency that the tailing is most likely to occur when a toner cartridge is brand new, while it is not so much likely to occur with the use of the toner cartridge.

Further, there is a tendency that the tailing is likely to occur when a conveyance speed of a recording sheet is fast, while it is not likely to occur when the conveyance speed is slow. This is because the manner the recording sheet receives heat from a fixing unit is different depending upon the difference in the conveyance speed of the recording sheet. More specifically, whether the recording sheet sharply receives heat or the recording sheet gently receives heat is different.

The following is considered to be the reason why there is a tendency that the tailing is most likely to occur when a toner cartridge is brand new, while it is not likely to occur with the use of the toner cartridge.

Toner in a new toner cartridge is uncharged. After the toner cartridge is used, not only the toner transferred onto a recording sheet but also the toner in the toner cartridge is charged. If the toner cartridge is left unused, the charges accumulated on the toner are gradually discharged.

When printing is performed with the toner in the toner cartridge charged, the charged condition of the toner transferred onto the recoding sheet also becomes satisfactory. Since the toner is fixed in strongly adhered state onto the recording sheet, the generation of tailing is restrained.

A new toner cartridge is full of toner. However, after the toner cartridge is started to be used, as the toner is consumed, the amount of toner in the toner cartridge is gradually decreased. With this, the toner in the toner cartridge is easy to be charged. As a result, the tailing is gradually becoming not likely to occur.

There is a tendency that the tailing is likely to occur when a conveyance speed of a recording sheet is fast, while it is not likely to occur when the conveyance speed is slow, according to the following reasons.

When the conveyance speed of the recording sheet is fast, the recording sheet sharply receives heat from the fixing unit. This increases force for causing the water contained in the recording sheet to be moisture vapor and be dissipated. When this force exceeds force for retaining a toner image on the recording sheet, the toner scatters, which produces the tailing.

On the contrary, when the conveyance speed of the recording sheet is slow, the recording sheet gently receives heat from the fixing unit. Therefore, the water contained in the recording sheet gradually becomes moisture vapor, and exhalation force of the moisture vapor is dispersed and weakened. Therefore, the toner image on the recording sheet is not likely to be affected by the exhalation force of the moisture vapor, which prevents the toner from scattering.

Accordingly, it has been found that the tailing, which is generated on a printed image, can be suppressed by eliminating the above-mentioned factors. The exemplary embodiments according to the present invention will be described in detail with reference to the drawings.

FIG. 1 is a block diagram illustrating an example of a configuration of a printer according to a first exemplary embodiment.

A central processing unit (CPU) 102 of a printer controller 101 controls the entire apparatus through a system bus 111 according to programs or set information stored in a read-only memory (ROM) 103 or nonvolatile random access memory (NVRAM) 107 using a random access memory (RAM) 104 as a work memory.

The ROM 103 also stores font data. The RAM 104 also functions as a reception buffer, a buffer for temporarily storing the rasterized image data, and a buffer for sending the image to the printer engine. The NVRAM 107 also stores a job count value.

An image forming unit (or image processing unit) 106 performs various image processing on print data according to the control of the CPU 102, and stores in an image memory 105 the image data, which has been subjected to rendering.

A host interface (IF) 108 is an interface through which the CPU 102 communicates with a host computer (PC) 1001 to receive a print job from the host PC 1001. The host interface (IF) 108 also sends status information or the like to the host PC 1001. The host interface (IF) 108 is, for example, a serial bus interface such as USB or IEEE1394.

The host interface (IF) 108 may be an interface for communicating with the host PC 1001. Therefore, the host interface (IF) 108 may be a wired interface or a wireless interface for connecting with a LAN or Internet.

A panel IF 109 is an interface through which the CPU 102 inputs various instructions for an operation from an operation panel 2001 and causes the operation panel 2001 to display various messages. The operation panel 2001 includes a liquid crystal display (LCD) for displaying various buttons and operation screen as a touch panel.

An engine IF 110 is an interface through which the CPU 102 communicates with the printer engine 3001 to receive status information or other information from the printer engine 3001, and outputs the image data, which is stored in the image memory 105, to the printer engine 3001.

A timer 112 outputs information indicating the current date according to a request from the CPU 102. A user can set the date of the timer 112 using of the operation panel 2001.

A process cartridge (PCRG) 301 can be mounted in the printer engine 3001. The process cartridge 301 includes a tag IC 321 that stores information about a type of an apparatus, new-cartridge information, date information, and the like, and a stirring unit 322 that stirs toner (recording agent) in a developing unit of the cartridge. The data can be read from or written to the tag IC, which is mounted on the process cartridge (PCRG) 301, through the engine IF 110.

A PCRG history management unit 113 manages a history of the process cartridge 301 according to the control of the CPU 102. The history can be managed by the process cartridge 301 in such a manner that the information recorded on the mounted tag IC 321 of the process cartridge 301 is read, and the date information is written to the tag IC 321 through the printer engine 3001. The date information may be recorded not only on the tag IC 321 but also on a non-volatile memory (e.g., NVRAM 107).

A toner remaining-amount detection unit 114 counts a dot number in image data of a print job, thereby estimating a toner amount to be consumed from the integration value, according to the control of the CPU 102.

In the case of a host-base printer, the host PC 1001 may execute this process. The remaining amount of toner may be detected by using a value of a toner remaining-amount sensor (not illustrated) in the developing unit 306. In this case, it is supposed that the toner remaining-amount sensor (not illustrated) is provided in the process cartridge 301, and it is electrically connected to a toner remaining-amount detecting sensor.

A PCRG condition determination unit 115 is connected to the process cartridge 301, and determines the condition of the process cartridge 301 according to the control of the CPU 102. More specifically, the PCRG condition determination unit 115 estimates the charged condition of the toner (recording agent) in the developing unit based on the history information of the PCRG history management unit 113, the toner remaining-amount information of the toner remaining-amount detection unit 114, and the information about whether the stirring is executed in a stirring detection unit 116. As a result, it can be stepwisely determined to what degree the tailing image is likely to be generated as a result of the execution of printing.

The stirring detection unit 116 indicates whether a stirring unit 322 in the developing unit 306 of the process cartridge 301 performs a stirring operation. When the stirring unit 322 performs the stirring operation of the process cartridge 301 during the initial operation when power is turned on, the stirring detection unit 116 sets a flag, and when the printing process is completed, resets the flag. When the stirring unit 322 performs the stirring operation of the process cartridge 301 by a calibration operation, the stirring detection unit 116 also sets a flag.

A sheet-conveyance-speed changeover pattern calculation unit 117 calculates a changeover pattern of a sheet conveyance speed according to the control of the CPU 102. When the printing is to be executed with a slow print mode, the sheet-conveyance-speed changeover pattern calculation unit 117 calculates how many pages are printed before the print mode is changed to a mode in which the print speed is faster in order to achieve the shortest time for printing the whole print job based on the determination result of the PCRG condition determination unit 115.

The sheet-conveyance-speed changeover pattern calculation unit 117 may make a control for printing the whole print job in the mode in which the print speed is slow, considering the time taken for the changeover of the print mode.

For example, in a case where the printer engine of which the fast mode is 16 ppm, the slow mode is 10 ppm, and the time taken for the changeover of the print mode is 3 seconds, if the mode is changed to the fast mode for the last one of the print job, the printing time is increased more than the printing time when the whole print job is printed in the slow mode.

The units from the timer 112 to the sheet-conveyance-speed changeover pattern calculation unit 117 are described as a hardware block. However, they may be managed on the RAM 104 by the CPU 102 according to the program in the ROM 103.

Figure 2:
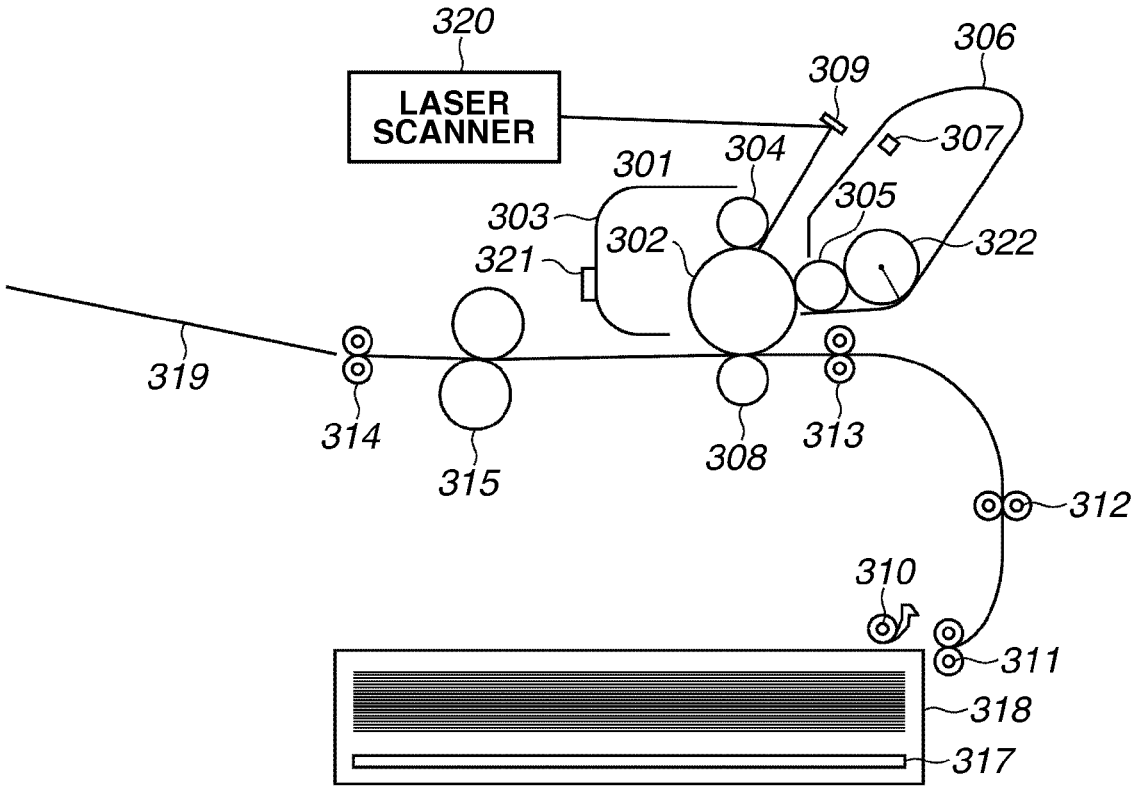
FIG. 2 illustrates an example of a configuration of a printer engine.

FIG. 2 illustrates an example of a configuration of the printer engine 3001.

The process cartridge 301 includes a photosensitive drum 302, a cleaner 303, a charging roller 304, a developing sleeve 305, the developing unit 306, the toner remaining-amount sensor 307, the tag IC 321, and the stirring unit 322, those of which are integrally provided. The process cartridge 301 is detachably mounted on the main body of the printer engine 3001.

An image forming process performed by the printer engine 3001 will be described below. Firstly, the charging roller 304 uniformly charges the photosensitive drum 302. Then, an image signal is fed to the laser scanner 320. The photosensitive drum 302 is scanned and exposed by laser beam according to the image signal, whereby an electrostatic latent image is formed on the photosensitive drum 302.

The laser beam is raster-scanned by a polygon scanner (not illustrated) in the laser scanner 320. An optical system and a folding mirror 309 in the laser scanner 320 forms an optical spot image on the photosensitive drum 302, thereby an electrostatic latent image is formed.

The electrostatic latent image is developed by the developing unit 306. A jumping development, two-component development, or FEED development is applied for developing the electrostatic latent image. A reversal development is mainly used, wherein laser beam is turned on at the portion where the dots are recorded to eliminate charges on the photosensitive drum 302, and toner is attached on the portion of the photosensitive drum 302 on which there are a few amount of charges. The stirring unit 322 stirs the toner in the developing unit 306 according to the control of the CPU 102.

On the other hand, the recording sheets are stored in a sheet cassette 318. A cassette heater 317 can heat the inside of the sheet cassette 318 for dehumidifying the recording sheets. The CPU 102 can control the amount (strength) of heat or on/off of the cassette heater 317.

When receiving the print job from the host PC 1001, the CPU 102 controls a sheet feed roller 310 to feed a recording sheet from the sheet cassette 318 to a conveyance path. The recording sheet is conveyed by conveyance rollers 311 and 312, and fed to the transfer unit according to a timing of forming a toner image by a timing roller 313.

Then, the toner image formed on the photosensitive drum 302 is transferred onto the recording sheet by the transfer roller 308. The transfer roller 308 is made of a conductive elastic member having low hardness. The transfer roller 308 electrostatically transfers the toner image using a bias electric field at the nip portion formed by the photosensitive drum 302 and the transfer roller 308.

The recording sheet having the toner image transferred thereon is conveyed to the fixing unit 315 where toner is fused and fixed through the application of heat and pressure. Then, the recording sheet is discharged to a discharge tray 319 by a discharge roller 314.

On the other hand, the toner not transferred to the recording sheet is scraped off from the photosensitive drum 302 by a blade provided on the cleaner 303, thereby the photosensitive drum 302 is cleaned.

The printer engine 3001 has an environment sensor not illustrated. The CPU 102 acquires environmental information, such as temperature and humidity in the vicinity of the printer engine 3001, from a signal of the environment sensor, and thereby it can appropriately control the image forming process described above.

The printer engine 3001 is configured to operate in two modes, i.e., in a mode in which a print speed is fast and in a mode in which a print speed is slow, by changing the process speed for performing the image forming process according to the control of the CPU 102.

[Print Control]

Figure 3:
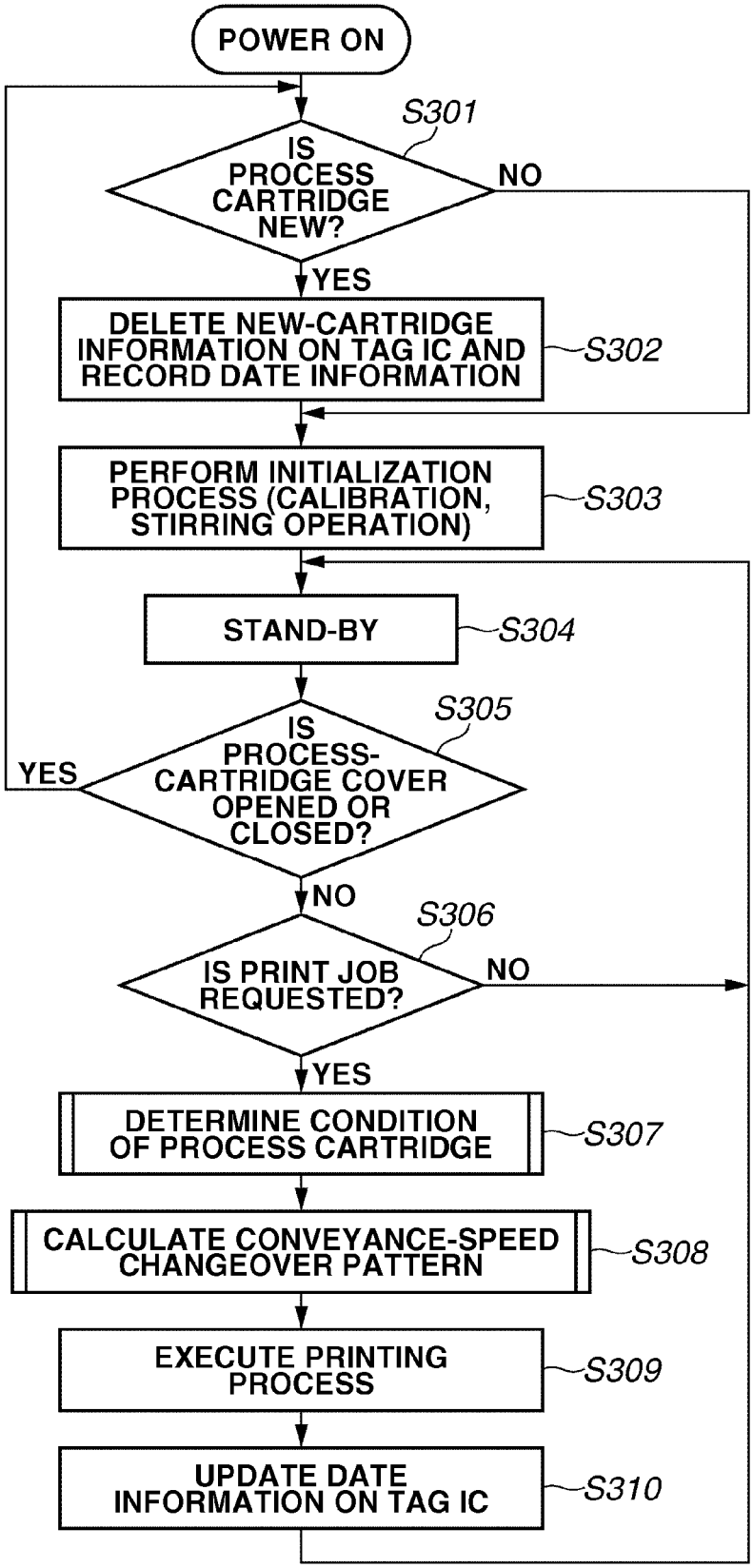
FIG. 3 is a flowchart illustrating one example of a print control executed by a printer controller.

FIG. 3 is a flowchart illustrating one example of a print control executed by the CPU 102 of the printer controller unit 101 according to the program in the ROM 103.

The flowchart illustrated in FIG. 3 starts when a print job including a plurality of pages is input from the host PC 1001.

In step S301, the CPU 102 reads the information recorded on the tag IC of the process cartridge 301 to determine whether the process cartridge is new. If the process determines that the process cartridge is not new (NO in step S301), the process proceeds to step S303.

When the process cartridge is new in S301 (YES in step S301), the processing proceeds to step S302. In step S302, the CPU 102 deletes the new-cartridge information in the tag IC, and records the date information indicating the current date acquired from the timer 112 on the tag IC.

Next, in step S303, the CPU 102 performs an initialization process including a calibration and stirring operation. The initialization process makes the printer in a stand-by state in which the printing process is possible. Then, in step S304 (stand-by mode), the CPU 102 waits until the host PC 1001 requests the print job.

When the cover of the process cartridge is opened or closed during the stand-by state in step S304 (YES in step S305), the CPU 102 confirms the content of the tag IC of the process cartridge for determining whether the process cartridge is exchanged. The process in step S305 determines whether the process cartridge is opened or closed. If the process is opened or closed (YES in step S305), the process goes back to step S301. Otherwise, the process proceeds to step S306 where the process determines whether a print job is request.

When, in step S306, the print job is requested during the stand-by state in step S304 (YES in step S306), the CPU 102 determines the charged condition of the toner in the developing unit from the date information recorded on the tag IC 321, the date information of the timer 112, the stirring flag, and information about the remaining amount of toner (Step S307—determine condition of process cartridge). If the process determines that a print job is not request (NO in step S306), the process go back to step S304, which is the stand-by mode.

Since the charged condition of the toner in the developing unit is related to the used condition of the process cartridge 301, the charged condition of the toner is determined through the determination of the used condition. More specifically, the PCRG condition determination unit 115 performs the process described below according to the control of the CPU 102.

The PCRG condition determination unit 115 estimates the charged condition of the toner (recording agent) in the developing unit 306 from the history information in the PCRG history management unit 113, the toner remaining-amount information in the toner remaining-amount detection unit 114, and the stirring information in the stirring detection unit 116. From this result, the PCRG condition determination unit 115 determines to what degree the tailing image is likely to occur if the printing is executed.

Next, the CPU 102 allows the sheet-conveyance-speed changeover pattern calculation unit 117 to execute the process described below. In step S308 (calculate conveyance-speed changeover pattern), the pattern calculation unit 117 calculates how the printing speed has to be changed in order to complete the printing in the shortest time, from the charged condition of the toner in the developing unit 306 (i.e., the used condition of the process cartridge), which is determined in step S307, and the print job.

Then, in step S309, the CPU 102 executes the printing process according to the print speed calculated in step S308. In step S310, after the printing process is completed in step S309, the CPU 102 updates the date information in the tag IC 321, and the processing returns to step S304.

The charged condition of the toner in the developing unit 306 is determined to be any one of levels 0 to 5 based on whether the toner is stirred, the remaining amount of toner, and the period during when the developing unit 306 is not used. The non-used period of the developing unit 306 can be acquired based on the date information recorded on the tag IC 321 and the date information (current date) on the timer 112 through the PCRG history management unit 113.

Table 1 illustrates the relationship between the charged level of the toner in the developing unit 306 and the print speed (conveyance speed of the sheet with respect to the fixing unit 315) at the printer engine 3001. The higher the charged level of the toner is, the smaller the charged amount of the toner is, which means that the tailing is easy to occur. Therefore, the number of sheets to be printed, in the mode in which the print speed is slow, increases.

TABLE 1

| Level of developing unit 306 | Print speed |
|---|---|
| Level 5 (Tailing is easy to occur): | up to 5 sheets in low speed |
| Level 4: | up to 4 sheets in low speed |
| Level 3: | up to 3 sheets in low speed |
| Level 2: | up to 2 sheets in low speed |
| Level 1: | only 1 sheet in low speed |
| Level 0 (Tailing may not occur): | in Normal speed |

As the non-used period of the developing unit 306 is long, the charges accumulated on the toner are discharged, so that the tailing is easy to occur. On the contrary, as the non-used period is short, the tailing is not likely to occur.

As the remaining amount of toner is great, charges are not accumulated easily on the toner in the developing unit 306 other than the toner consumed for the printing during the printing process, so that the tailing is easy to occur. On the contrary, as the remaining amount of toner is small, the tailing does not easily occur.

When the stirring is not executed, the toner in the developing unit 306 (or the process cartridge 301) is not uniformly charged, so that the tailing is easy to occur. On the contrary, when the stirring is executed, the tailing does not easily occur.

The relationship between the level of the charged condition of the toner in the developing unit 306 and the print speed is as described below. the print speed is represented by a number of pages that can be printed in one minute for A4-size paper.

The level 0 means the state in which the tailing is most unlikely to occur, which means that the print speed does not need to decrease. The level 1 means the state in which the tailing does not occur if printing is performed with a slower speed with a sheet fewer than the normal print speed. Similarly, the level 2 means the state in which the tailing does not occur if two sheets are printed with a slower speed than the normal print speed. The level 3 means the state in which the tailing does not occur if three sheets are printed with a slower speed than the normal print speed. The level 4 means the state in which the tailing does not occur if four sheets are printed with a slower speed than the normal print speed. The level 5 means the state in which the tailing is most likely to occur, which means up to five sheets have to be printed with a slow speed.

As described above, the print speed is determined according to the level of the charged condition of the toner in the developing unit 306.

The print speed is determined beforehand depending upon the level. To what degree the print speed is decreased more than the normal print speed for each level has been described above. However, the present invention is not limited thereto. Specifically, the print speed may be determined beforehand according to the respective levels.

Figure 4A:
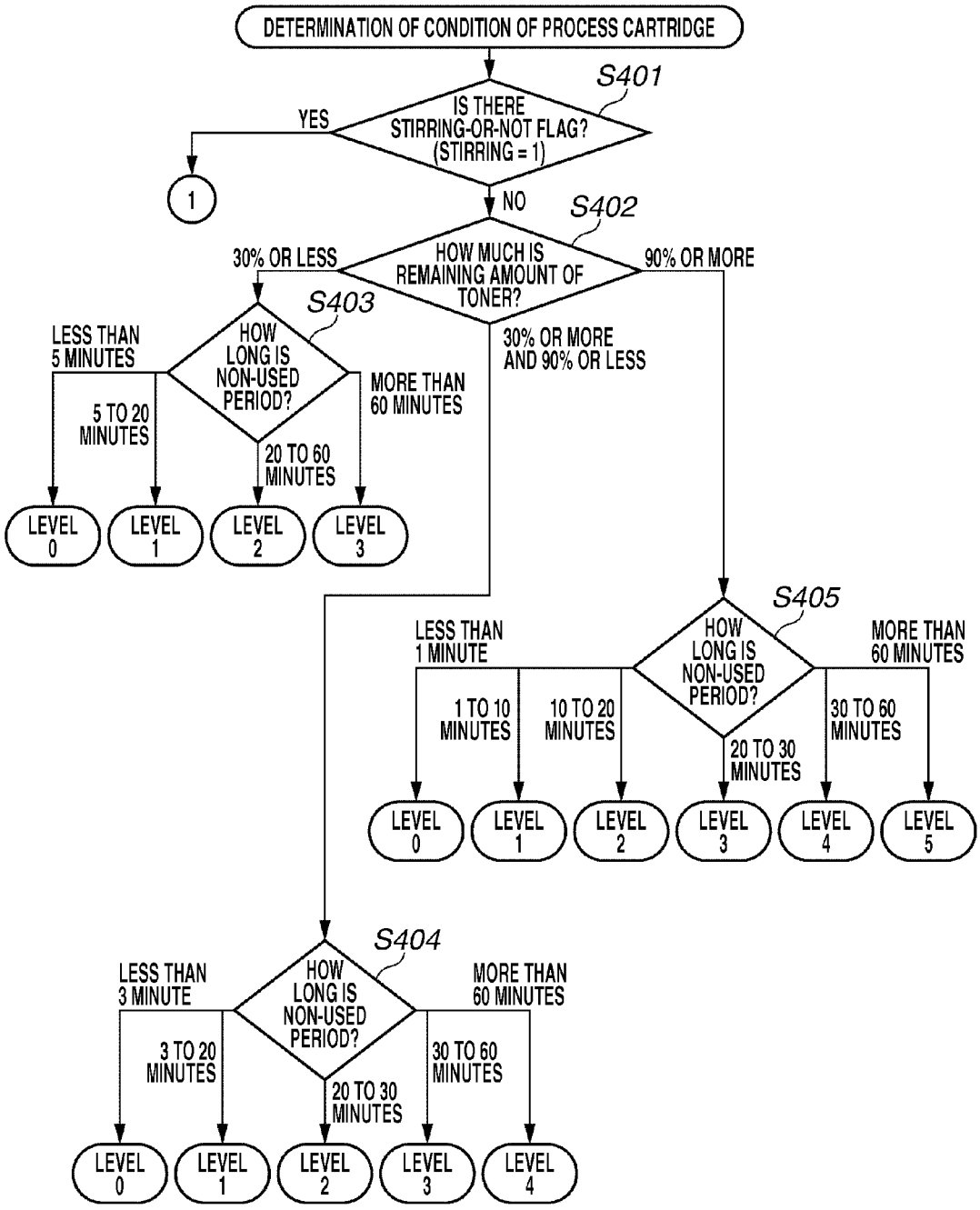
FIGS. 4A and 4B are a flowchart illustrating one example of a process for determining the condition of a process cartridge.
Figure 4B:
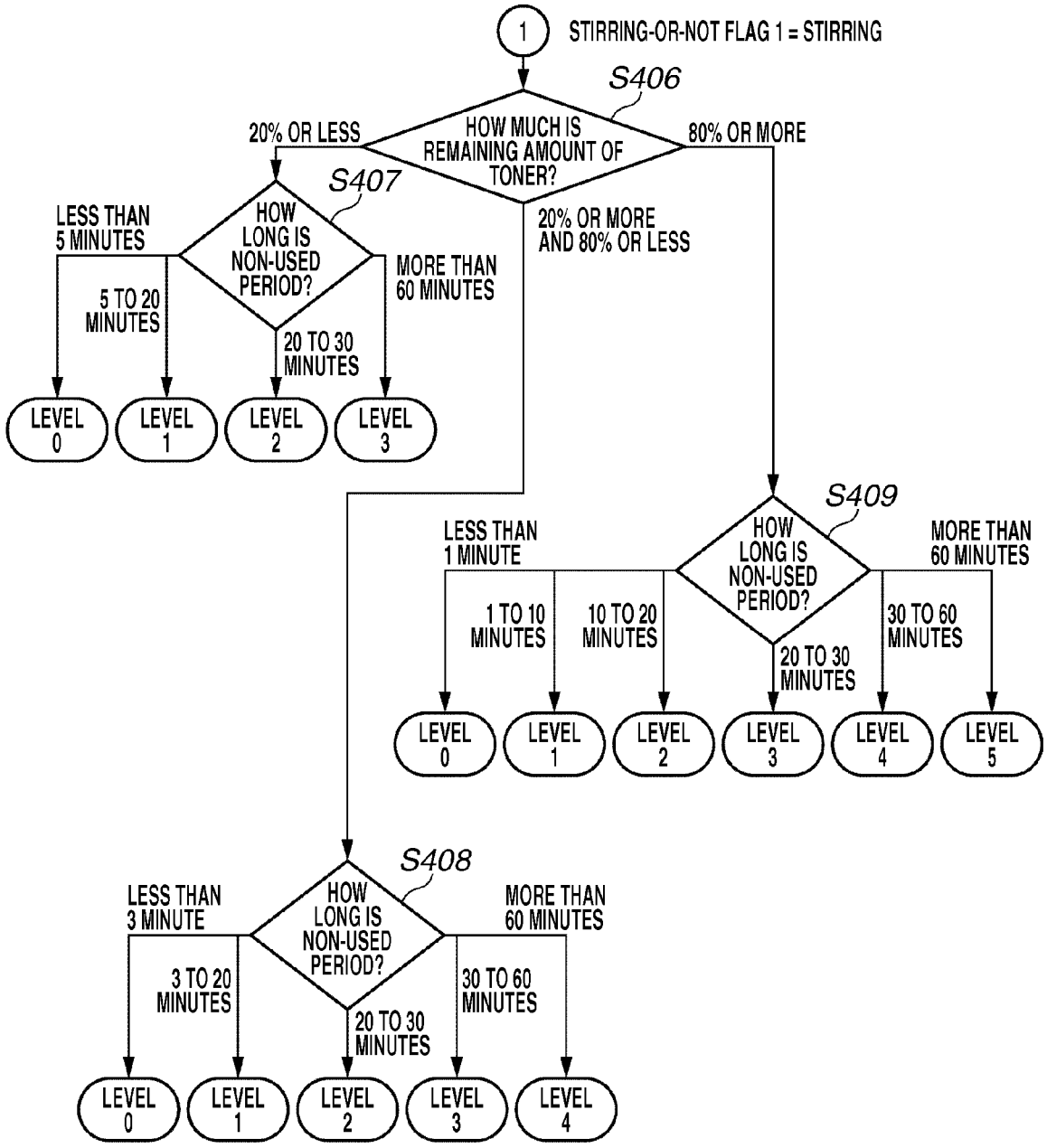

FIG. 4 is a flowchart illustrating one example of a process for determining the condition of the developing unit 306 (process cartridge 301). The flowchart illustrated in FIG. 4 is executed by the CPU 102 according to the program in the ROM 103.

In step S401, the CPU 102 firstly confirms the stirring flag through the stirring detection unit 116 to determine whether the stirring unit 322 executes the stirring operation.

When it is determined in step S401 that the stirring operation is not performed (NO in step S401), the CPU 102 detects the remaining amount of toner through the toner remaining-amount detection unit 114. Then, in step S402, the CPU 102 selects the following step depending upon whether the remaining amount of toner is 30% or less, 30% or more and 90% or less, and 90% or more.

When the remaining amount of toner is 30% or less, the CPU 102 detects the non-used period of the developing unit 306 by the PCRG condition determination unit 115. In step S403, the CPU 102 determines the charged condition of the toner at present in the developing unit 306 within the levels of 0 to 3, depending upon whether the non-used period is less than 5 minutes, 5 to 20 minutes, 20 to 60 minutes, or more than 60 minutes.

In step S404, when the remaining amount of toner is 30% or more and 90% or less, the CPU 102 determines the condition of the toner at present in the developing unit 306 within the levels of 0 to 4, depending upon whether the non-used period is less than 3 minutes, 3 to 20 minutes, 20 to 30 minutes, 30 to 60 minutes, or more than 60 minutes.

In step S405, when the remaining amount of toner is 90% or more, the CPU 102 determines the condition of the toner at present in the developing unit 306 within the levels of 0 to 5, depending upon whether the non-used period is less than 1 minute, 1 to 10 minutes, 10 to 20 minutes, 20 to 30 minutes, 30 to 60 minutes, or more than 60 minutes.

When the CPU 102 determines that the stirring operation is performed in step S401, the CPU 102 detects the remaining amount of toner through the toner remaining-amount detection unit 114. In step S406, the CPU 102 selects the following step depending upon whether the detected remaining amount of toner is 20% or less, 20% or more and 80% or less, or 80% or more.

In step S407, when the remaining amount of toner is 20% or less, the CPU 102 determines the condition of the toner at present in the developing unit 306 within the levels of 0 to 3, depending on whether the non-used period of the developing unit 306 is less than 5 minutes, 5 to 20 minutes, 20 to 60 minutes, or more than 60 minutes.

In step S408, when the remaining amount of toner is 20% or more and 80% or less, the CPU 102 determines the condition of the toner at present in the developing unit 306 within the levels of 0 to 4, depending on whether the non-used period of the developing unit 306 is less than 3 minutes, 3 to 20 minutes, 20 to 30 minutes, 30 to 60 minutes, or more than 60 minutes.

In step S409, when the remaining amount of toner is 80% or more, the CPU 102 determines the condition of the toner at present in the developing unit 306 within the levels of 0 to 5, depending on whether the non-used period of the developing unit 306 is less than 1 minutes, 1 to 10 minutes, 10 to 20 minutes, 20 to 30 minutes, 30 to 60 minutes, or more than 60 minutes.

In the manner described above, the CPU 102 determines the level of the charged condition of the toner in the developing unit 306.

In the present exemplary embodiment described above, the CPU 102 determines the charged condition of the toner in the developing unit 306. However, the present invention is not limited thereto. More specifically, the charged condition of the toner in the developing unit 306 may be determined by the printer engine 3001, the developing unit 306, the host PC 1001, and the like.

In the present exemplary embodiment, the charged condition of the toner in the developing unit 306 is determined based on the remaining amount of toner, the non-used period, or whether the stirring operation is performed. However, the present invention is not limited thereto. More specifically, the charged condition of the toner may be determined based on one or more factors described above. Further, the charged condition of the toner may be determined by directly measuring the charged amount in the developing unit 306.

In the present exemplary embodiment describes above, the printing control is executed based upon the process cartridge 301 including the photosensitive drum 302, cleaner 303, charging roller 304, developing sleeve 305, developing unit 306, and toner remaining-amount sensor 307, those of which are formed integral with the process cartridge 301.

However, the printing control may be executed in the similar manner according to the used condition of the toner cartridge, in the case of the toner cartridge in which these components are not integrally formed. Even in the case of an apparatus in which toner, which is not a cartridge type, is replenished to the developing unit, the condition of the toner may be determined according to the used condition of the developing unit for executing the printing control in the same manner as described above.

FIG. 5 is a flowchart illustrating one example of a process of calculating a conveyance-speed changeover pattern of a recording sheet. FIG. 5 is a flow of a process that the CPU 102 causes the sheet-conveyance-speed changeover pattern calculation unit 117 to execute according to the program in the ROM 103.

In the present exemplary embodiment, the sheet-conveyance-speed changeover pattern calculation unit 117 executes the calculation of the conveyance-speed changeover pattern of a recording sheet. However, the CPU 102 may execute the calculation of the conveyance-speed changeover pattern of a recording sheet.

In this flowchart, the time taken to change the print mode is defined as T1, the time taken to print one sheet in a mode in which the print speed is slow is defined as T2, and the time taken to print one sheet in the normal print mode is defined as T3.

The number of remaining pages of the print job, which can be printed in either one of the print modes, is defined as M, and the number of pages, if printed in the mode in which the print speed is slow, that can be printed in a shorter period than that if printed with the changed normal mode, is defined as X.

Firstly, in step S501, the CPU 102 determines whether the level (L) of the developing unit 306 is 0. When the level (L) of the developing unit 306 is 0 in step S501 (YES in step S501), which means the tailing does not occur easily, the process advances to step S508 where in step S508, the whole print job is printed in the normal print mode.

When the level (L) of the developing unit 306 is not 0 in step S501 (NO in step S501), the processing proceeds to step S502. In step S502, the CPU 102 compares the page number (J) of the print job and the number of pages (L) that is determined by the level (L) of the process cartridge and that is to be continuously printed with low speed.

The number of pages (L) that is to be continuously printed with low speed is the number of pages by which the tailing does not easily occur due to the continuous printing, and it is set as a predetermined number of pages.

When L is set as the predetermined number of pages, the print speed (conveyance speed) is changed in such a manner that the first to Lth pages are printed with low speed after the printing process is started, and the pages after the Lth page are printed with a normal print speed.

In step S507, when J≦L is satisfied in step S502 (YES in step S502), the whole print job is printed in the print mode in which the print speed is slower than that of the normal print mode.

When J≦L is not satisfied in step S502 (NO in step S502), the processing proceeds to step S503. In the subsequent steps to step S503, the CPU 102 calculates how many pages are printed before the print mode is changed in order to achieve the shortest time for printing the whole print job.

In step S503 (i.e., obtain number of remaining sheets (M) of print job that can be printed in either one of print modes (obtain value of J−L), the number of remaining pages (M) of the print job, which can be printed in either one of print modes, is calculated using the value of J−L. Then, in step S504, the value (X) that satisfies the equation of T2*X=T1+(T3*X) is obtained. Next, in step S505, the value of M and the value of X are compared.

When M≦X is satisfied in step S505 (YES in step S505), the processing proceeds to step S507. In step S507, the whole print job is printed in the print mode in which the print speed is slower than that of the normal print mode.

When M≦X is not satisfied in step S505 (NO in step S505), the processing proceeds to step S506. In step S506, the first L pages are printed in the print mode in which the print speed is slower than that of the normal print mode, and then, the pages after the Lth page, i.e., the remaining M pages, are printed with the print mode being changed to the normal print mode. The process is terminated.

For example, in the case of the printer engine in which the speed in the normal print mode is 16 ppm, the speed in the slow mode is 10 ppm, the time to change the print mode, for example, is 3 seconds, T1=3, T2=6, and T3=3.75. In this case, as a result of the calculation, X=1 is obtained. Therefore, when only last one page of the print job is printed in the normal print mode, the longer printing time is taken than in the case where the whole print job is printed in the slow mode.

Therefore, when the printing process is executed with the level 5, the control described below is made. That is, all sheets are printed in the slow mode if the print job includes 6 or less sheets, while the first 5 sheets are printed in the slow mode and the remaining 2 sheets are printed in the normal mode if the print job includes 7 or more sheets.

In the present exemplary embodiment, the recording sheet is conveyed in the printing apparatus with a low conveyance speed, the present invention is not limited thereto.

When the recording sheet sharply receives heat from the fixing unit, the force for causing the water contained in the recording sheet to be vaporized and expanded extremely increases. Therefore, the tailing is easy to occur. Accordingly, it is enough that the sheet conveyance speed is reduced to the speed according to the charged condition of the toner in the developing unit 306 when the recording sheet passes through the fixing unit 315.

Consequently, it may be controlled such that the recording sheet is conveyed with a higher speed than the sheet conveyance speed determined based upon the charged condition of the toner in the developing unit 306 before reaching the fixing unit, and the conveyance speed is decelerated to the sheet conveyance speed determined based upon the charged condition of the toner immediately before the fixing unit.

The present invention is applicable to a system or an integrated apparatus configured by a plurality of devices (e.g., host computer, interface device, printer controller, printer engine), or to an apparatus configured by one device.

The present invention can be realized by supplying a storage medium (or recording medium) having stored therein a control program realizing the function of the above-mentioned exemplary embodiment to a system or an apparatus. The present invention is also achieved through reading and execution of the program code stored in the storage medium by the computer (or CPU or micro-processing unit (MPU)) of the system or the apparatus.

In this case, the program code itself read from the storage medium realizes the function of the above-mentioned exemplary embodiment, and the storage medium that stores the program code constitutes the present invention.

The present invention encompasses not only the case in which the exemplary embodiment is realized through the execution of the read code by the computer, but also the case in which the computer executes some or all actual processes to be performed by an operating system (OS) operated on the computer based on the instruction from the program code, wherein the function of the above-mentioned exemplary embodiment is realized by these processes.

Moreover, the program code read from the storage medium is written in a function expansion card inserted into the computer or a memory provided to a function expansion unit connected to the computer. Thereafter, a CPU provided to the function expansion card or the function expansion unit executes some or all processes based on the instruction from the program code. These processes can of course realize the function of the exemplary embodiment described above.

When the present invention is applied to the above-mentioned storage medium, the program code corresponding to the flowchart, which is previously described, is stored in the storage medium.

The present invention can also be realized by only hardware or a combination of hardware and software.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2008-299641 filed Nov. 25, 2008, which is hereby incorporated by reference herein in its entirety.

What is claimed is:

1. An image forming apparatus comprising:

a developing unit configured to develop an image on a photosensitive drum using a recording agent;

a transfer unit configured to transfer the image developed by the developing unit onto a sheet;

a fixing unit configured to fix the image transferred by the transfer unit onto the sheet;

a stirring unit configured to stir the recording agent stored in the developing unit; and a control unit configured to control the sheet to be conveyed such that the sheet is passed through the fixing unit with a first conveyance speed in case the stirring unit has already stirred the recording agent, and to control the sheet to be conveyed such that the sheet is passed through the fixing unit with a second conveyance speed, which is slower than the first conveyance speed, in case the stirring unit has not yet stirred the recording agent.

2. An image forming apparatus comprising:

a developing unit configured to develop an image on a photosensitive drum using a recording agent;

a transfer unit configured to transfer the image developed by the developing unit onto a sheet;

a fixing unit configured to fix the image transferred by the transfer unit onto the sheet;

a detection unit configured to detect a remaining amount of the recording agent in the developing unit; and a control unit configured to control the sheet to be conveyed such that the sheet is passed through the fixing unit with a first conveyance speed in case the remaining amount of the recording agent detected by the detection unit is smaller than a predetermined remaining amount, and to control the sheet to be conveyed such that the sheet is passed through the fixing unit with a second conveyance speed, which is slower than the first conveyance speed, in case the remaining amount of the recording agent detected by the detection unit is larger than the predetermined remaining amount.

3. An image forming apparatus comprising:

a developing unit configured to develop an image on a photosensitive drum using a recording agent;

a transfer unit configured to transfer the image developed by the developing unit onto a sheet;

a fixing unit configured to fix the image transferred by the transfer unit onto the sheet;

a counting unit configured to count a non-used period of the recording agent in the developing unit; and a control unit configured to control the sheet to be conveyed such that the sheet is passed through the fixing unit with a first conveyance speed in case the non-used period of the recording agent counted by the counting unit is shorter than a predetermined period, and to control the sheet to be conveyed such that the sheet is passed through the fixing unit with a second conveyance speed, which is slower than the first conveyance speed, in case the non-used period of the recording agent counted by the counting unit is longer than the predetermined period.

4. The image forming apparatus according to claim 3, wherein, in case a plurality of sheets are printed, the control unit controls a predetermined number of sheets among the plurality of sheets to be conveyed toward the fixing unit with the second conveyance speed, and controls the remaining sheets of the plurality of sheets to be conveyed to the fixing unit with the first conveyance speed, in case the non-used period of the recording agent counted by the counting unit is longer than the predetermined period.

5. An image forming method comprising:

developing an image on a photosensitive drum using a recording agent;

transferring the developed image onto a sheet;

fixing the transferred image by a fixing unit;

stirring the recording agent; and controlling the sheet to be conveyed such that the sheet is passed through the fixing unit with a first conveyance speed in case the recording agent has already been stirred, and controlling the sheet to be conveyed such that the sheet is passed through the fixing unit with a second conveyance speed, which is slower than the first conveyance speed, in case the recording agent has not yet stirred.

6. An image forming method comprising:

developing an image on a photosensitive drum using a recording agent;

transferring the developed image onto a sheet;

fixing the transferred image by a fixing unit;

detecting a remaining amount of the recording agent; and controlling the sheet to be conveyed such that the sheet is passed through the fixing unit with a first conveyance speed in case the detected remaining amount of the recording agent is smaller than a predetermined remaining amount, and controlling the sheet to be conveyed such that the sheet is passed through the fixing unit with a second conveyance speed, which is slower than the first conveyance speed, in case the remaining amount of the detected recording agent is larger than the predetermined remaining amount.

7. An image forming method comprising:

developing an image on a photosensitive drum using a recording agent;

transferring the developed image onto a sheet;

fixing the transferred image by a fixing unit;

counting a non-used period of the recording agent; and controlling the sheet to be conveyed such that the sheet is passed through the fixing unit with a first conveyance speed in case the counted non-used period of the recording agent is shorter than a predetermined period, and controlling the sheet to be conveyed such that the sheet is passed through the fixing unit with a second conveyance speed, which is slower than the first conveyance speed, in case the counted non-used period of the recording agent is longer than the predetermined period.

* * * * *